US009890655B2

(12) United States Patent
Leithead et al.

(10) Patent No.: US 9,890,655 B2
(45) Date of Patent: Feb. 13, 2018

(54) ADJUSTING DEVICE FOR VARIABLE GUIDE VANES AND METHOD OF OPERATION

(75) Inventors: Graeme Leithead, Sileby (GB); Michael Smith, North Hykeham (GB); Philip Twell, Lincoln (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 1400 days.

(21) Appl. No.: 13/061,962

(22) PCT Filed: Sep. 15, 2009

(86) PCT No.: PCT/EP2009/061953
§ 371 (c)(1),
(2), (4) Date: Mar. 3, 2011

(87) PCT Pub. No.: WO2010/031768
PCT Pub. Date: Mar. 25, 2010

(65) Prior Publication Data

US 2011/0182715 A1 Jul. 28, 2011

(30) Foreign Application Priority Data

Sep. 18, 2008 (EP) ..... 08016490

(51) Int. Cl.
*F01D 17/16* (2006.01)
*F01D 17/20* (2006.01)

(52) U.S. Cl.
CPC ..... *F01D 17/162* (2013.01); *F01D 17/20* (2013.01); *F05D 2260/79* (2013.01)

(58) Field of Classification Search
USPC ..... 415/161
See application file for complete search history.

(56) References Cited

U.S. PATENT DOCUMENTS 3,779,665 A 12/1973 Tatem, Jr. et al.
3,799,689 A * 3/1974 Moriguti et al. ..... 415/26
4,295,784 A 10/1981 Manning
4,695,220 A 9/1987 Dawson
(Continued)

FOREIGN PATENT DOCUMENTS

CN 1070717 A 4/1993
CN 1316582 A 10/2001
DE 1805942 6/1969
(Continued)

*Primary Examiner* — Igor Kershteyn
*Assistant Examiner* — Kayla McCaffrey

(57) ABSTRACT

A device, system, or method to position variable guide vanes disproportionately is provided. An adjusting device for guide vanes of an axial-flow machine, includes a plurality of rotatably mounted rings of variable guide vanes, a plurality of levers which are arranged on the outer sides of a guide vane carrier for rotating the variable guide vanes, a plurality of adjusting rings, each of the adjustment rings is arranged coaxially to the guide vane carrier and to which a first end of one of the levers is connected, and an adjusting drive with which the adjusting rings may be moved in the peripheral direction. At least one of the levers is set up to perform at least partly a disproportionate longitudinal movement of the first end of the at least one lever.

9 Claims, 11 Drawing Sheets

(56) References Cited

U.S. PATENT DOCUMENTS

| | | | | |
|---|---|---|---|---|
| 4,720,237 | A | 1/1988 | Weiner et al. | |
| 2005/0254938 | A1* | 11/2005 | Sheath et al. | 415/160 |

FOREIGN PATENT DOCUMENTS

| | | | | |
|---|---|---|---|---|
| EP | 1207271 | A2 | 5/2002 | |
| EP | 1489267 | A1 | 12/2004 | |
| RU | 2145391 | C1 | 2/2000 | |
| SU | 121094 | A1 | 3/1957 | |
| WO | WO 2007134787 | A1 * | 11/2007 | F01D 17/16 |

* cited by examiner

FIG 14
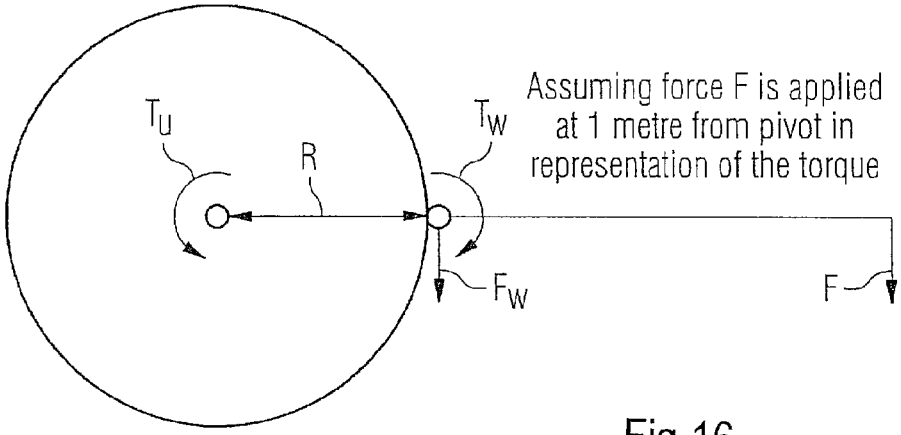
Applying $T_W$ gives a force of $F_W$
Fig 16
| Stage | Unison Ring $T_W$ Rad R (m) for 5.2 | (Nm) | F(N) | $F_W$(N) | Torque applied to unison ring $T_U$ (Nm) |
|---|---|---|---|---|---|
| S1 | 0.354 | 100 | 100 | 382.49 | 135.40 |
| S2 | 0.3465 | 100 | 100 | 388.60 | 134.65 |
| S3 | 0.3395 | 100 | 100 | 394.55 | 133.95 |
| S4 | 0.3395 | 100 | 100 | 394.55 | 133.95 |
FIG 15A
idle
FIG 15B
startup until intermediate position
FIG 15C
late startup or during operation
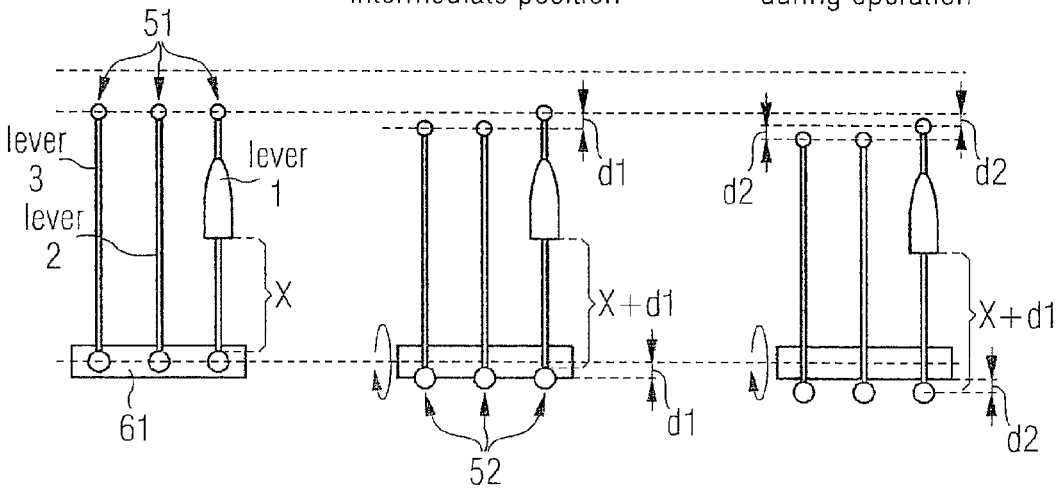

ADJUSTING DEVICE FOR VARIABLE GUIDE VANES AND METHOD OF OPERATION

CROSS REFERENCE TO RELATED APPLICATIONS

This application is the US National Stage of International Application No. PCT/EP2009/061953, filed Sep. 15, 2009 and claims the benefit thereof. The International Application claims the benefits of European Patent Office application No. 08016490.8 EP filed Sep. 18, 2008. All of the applications are incorporated by reference herein in their entirety.

FIELD OF INVENTION

The invention relates to a method, system, device for variable guide vanes.

BACKGROUND OF INVENTION

A gas turbine comprises a turbine and a compressor driven by the turbine. In particular, when the gas turbine is provided for a gas-steam power plant, the compressor is of the axial flow type. Commonly, the gas turbine is subjected to varying operating conditions resulting in different aerodynamic flow conditions within the compressor. In order to adapt the compressor performance to different operating demands, it is known to provide the compressor with variable guide vanes (VGV). The variable guide vanes are to be pivoted about their longitudinal axis in order to adjust their angle of attack.

Each variable guide vane is provided with a journal at its root, wherein the journal is pivot-mounted in a through hole in the compressor casing. The journal is phenomenal accessible from outside the compressor casing and comprises a lever to be actuated for pivoting the variable guide vane. All levers are coupled by means of a unison ring arranged concentrically around the compressor casing. The rotation of the unison ring actuates each of the variable guide vane levers simultaneously to achieve a corresponding rotational setting of each variable guide vane within the compressor casing.

An axial compressor consists of multiple stages of stator and rotor vanes (rotor blades). The front stages of stator vanes have variable pitch to control the flow. Flow control is important on engine run up to avoid surge.

Such a construction with variable pitch of the stator vanes is called "Variable Guide Vanes" (VGV).

It is known that individual vanes pitch or angular offset is controlled via a linkage mechanism comprising (see also FIGS. 1, 2 and 3):

i) A vane (10, 11) is mounted on a spindle (22) to allow angular movement of the vane.

ii) A short lever (20) connects the spindle to a driving ring (40, 41, 42, 43), the so called unison ring, all vanes in a single stage connecting to the same ring. See also FIG. 1, specifically showing individual vane (10) and lever (20).

iii) Each ring is rotated via a push rod (50) from a common bell crank (61). See also FIGS. 2 and 3, wherein FIG. 2 is showing the whole basic mechanism: Ram Drives for the stages through different amounts of rotation via the bell crank (61). FIG. 3 is showing the end view of the compressor system, as previously known.

iv) The bell crank (61) is rotated via a single hydraulic ram (60) (see again FIGS. 2 and 3).

Typically the arm through lengths of the bell crank (61) are set to give the required rotation of each unison ring and thus the angle of all the vanes on a single stage. See FIG. 4 showing a bell crank with arms (62, 63, 64) to attach the push rods to the bell crank. The arm 62 is longer than arm 63, which are again longer than arm 64.

With the use of a single driving ram the angular position during ram travel is proportional stage to stage. In some cases it may not be ideal to have a proportional system.

Non proportional operation could be achieved by several methods including individual stage rams.

SUMMARY OF INVENTION

It is an object of the invention to provide an alternative device and/or system and/or method to individually adjust the vanes of the stages.

This objective is achieved by the independent claims. The dependent claims describe advantageous developments and modifications of the invention.

In accordance with the invention there is provided a mechanism that only the first stage is moved differently than the other stages, particularly during start and/or stop of the turbine. Besides, the invention is directed to a sprung pushrod and a mechanism, how the sprung pushrod is attached to the unison ring.

Specifically an adjusting device for guide vanes of an axial-flow machine is provided, comprising a plurality of rotatably mounted rings of variable guide vanes, a plurality of levers—the previously mentioned push rod—which are arranged on the outer sides of a guide vane carrier for rotating the variable guide vanes, a plurality of adjusting rings, each of the adjustment rings is arranged coaxially to the guide vane carrier and to which a first end of one of the levers is connected, and an adjusting drive with which the adjusting rings can be moved in its peripheral direction. At least one of the levers is set up to perform at least partly a disproportionate longitudinal movement of the first end of the at least one lever.

The invention allows a higher angular rotation on the first stage and smaller rotations on the further or the last variable stage(s).

In a preferred embodiment the disproportionate longitudinal movement of the first end of the at least one lever resulting in a disproportionate rotation of the respective adjusting ring.

In a further preferred embodiment a single driving ram—preferably via a bell crank which is located in between the driving ram and the plurality of levers—may be attached to a second end of the plurality of levers.

In yet another embodiment the disproportionate longitudinal movement of the first end of the at least one lever may be set up as that from an initial position of the driving ram to an intermediate position the first end of the at least one lever stays immobile in its position.

In a further embodiment the disproportionate longitudinal movement of the first end of the at least one lever may be set up as that from the intermediate position of the driving ram further movement of the driving ram causing the first end of the at least one lever to move as the other first ends of the other levers.

In yet another embodiment the moving of the first end of the at least one lever may result in rotation of the respective adjusting ring.

Besides, the rotation of the respective adjusting ring may result in rotation of the variable guide vanes.

In a further embodiment one of the levers, preferably the at least one lever, may comprise a spring.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

The aspects defined above and further aspects of the present invention are apparent from the examples of embodiment to be described hereinafter and are explained with reference to the examples of embodiment.

BRIEF DESCRIPTION OF THE DRAWINGS

Embodiments of the invention will now be described, by way of example only, with reference to the accompanying schematical drawings, of which:

FIG. 14: shows exemplary forces that may be applied to the sprung push rod;

FIG. 15: shows schematically three different positions during operation of a bell crank applied to three compressor stages.

FIG. 16 shows exemplary forces that may be applied to the sprung push rod in table form.

The illustration in the drawing is schematical. It is noted that for similar or identical elements in different figures, the same reference signs will be used.

DETAILED DESCRIPTION OF INVENTION

Some of the features and especially the advantages will be explained for an assembled gas turbine, but obviously the features can be applied also to the single components of the gas turbine but may show the advantages only once assembled and during operation. But when explained by means of a gas turbine during operation none of the details should be limited to a gas turbine while in operation.

The invention may be applied to a gas turbine engine that can generally include a compressor section 1 (see FIG. 2), a combustor section (not shown) and a turbine section (not shown). A centrally disposed rotor (not shown) can extend through these three sections. The compressor section 1 can include alternating rows of vanes 10, 11, . . . and rotating blades (not shown).

The invention is directed to a compressor with "Variable Guide Vanes" (VGV). This is a construction with variable pitch of the stator vanes 10, 11, . . . .

Based on FIGS. 1, 2, 3, and 4 the general concept of "Variable Guide Vanes" is explained. These concepts also apply to the invention. The pitch or the angular offset for an individual stage of vanes inside of the compressor wall is controlled via a linkage mechanism which is applied from the outside of the wall.

Figure 1:
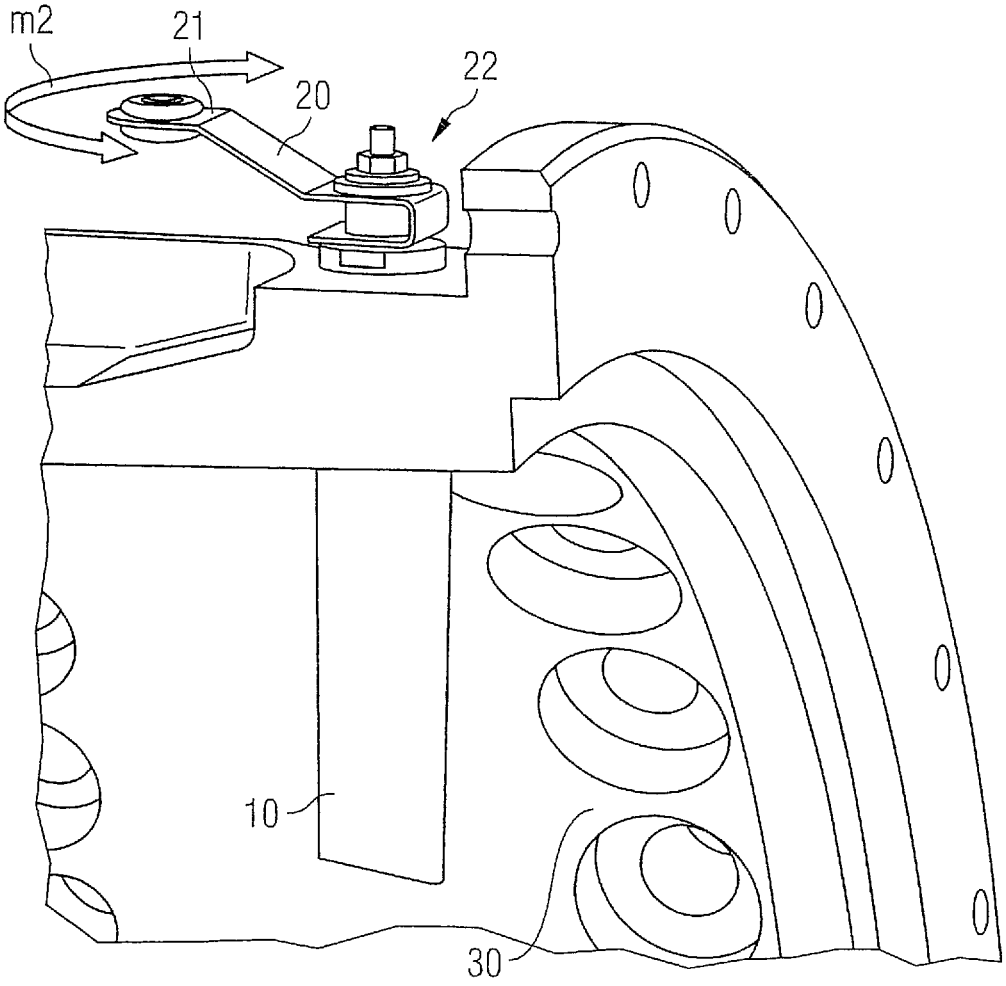
Prior Art FIG 1
FIG. 1: is a part of a perspective view of a known compressor stage of a turbine engine.
Figure 2:
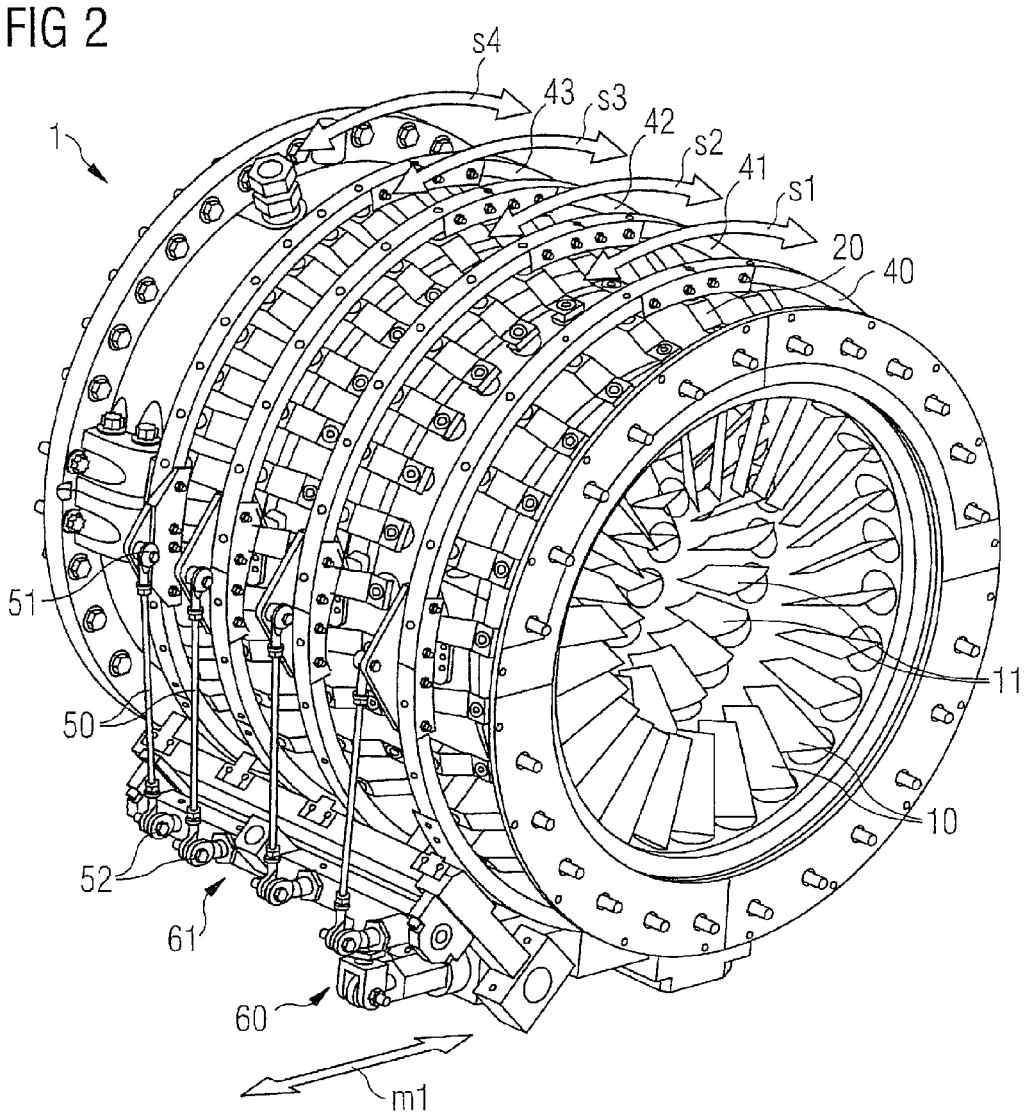
Prior Art FIG 2
FIG. 2: is a perspective view of a compressor of a known turbine engine.
Figure 3:
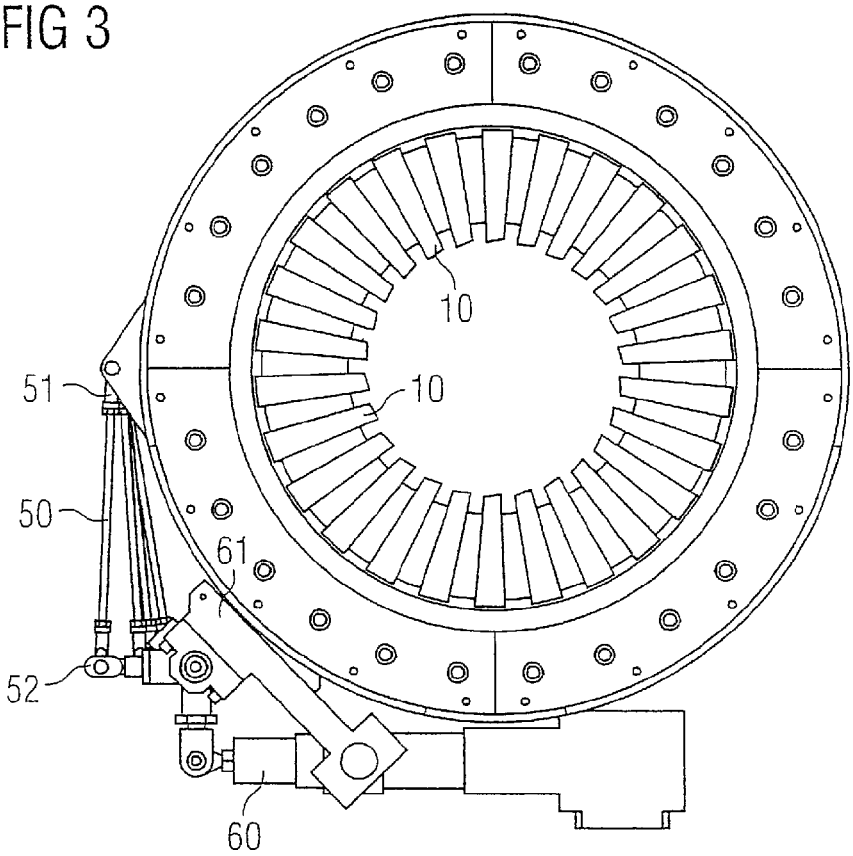
Prior Art FIG 3
FIG. 3: is a view of a compressor directed to the inlet end of the compressor.
Figure 4:
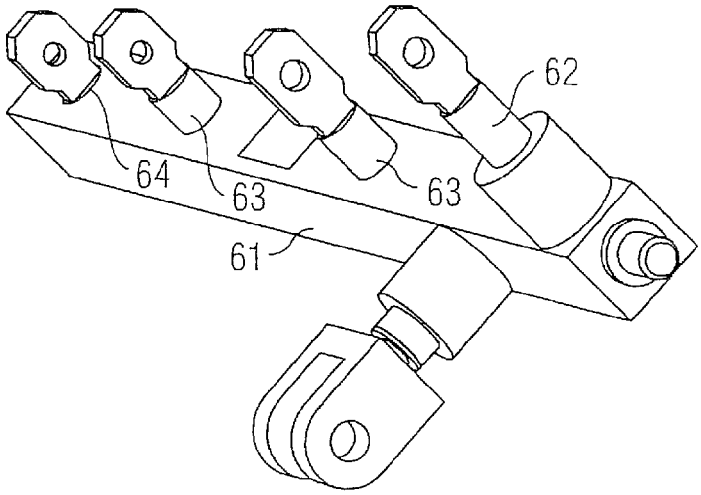
FIG 4 Prior Art
FIG. 4: is a perspective view of a known bell crank of a compressor of a turbine engine.

Each individual vane 10 (first stage), 11 (second stage), . . . is mounted on a spindle 22 to allow angular movement of the vane 10, 11. A short lever 20 connects the spindle 22 to a driving ring 40, 41, 42, 43 as adjustment ring, the so called unison ring. All vanes 10, 11, . . . in a single stage are connected to the same ring so that all vanes 10, 11, . . . on one stage are adjusted at the same time and with the same angle. Each of the adjustment rings is arranged coaxially to the guide vane carrier 30. FIG. 1 shows specifically showing individual vane 10 of the first stage—e.g. the most upstream stage of the compressor—and its corresponding lever 20. FIG. 2 shows an overall view of a compressor that shows a complete stage of vanes 10 of the first stage.

Each lever 20 has a connecting piece 21 that links the lever 20 to the corresponding driving ring 40, 41, 42, 43. Each of the driving rings 40, 41, 42, 43 is rotated via a push rod 50—one per ring—from a common bell crank 61.

The basic mechanism is as follows: a ram drive 60—possibly hydraulic—will be laterally moved (indicated by arrow m1). This lateral movement results in a turning of the bell crank 61. The bell crank may have different arms (62, 63, 64) with different lengths, one per stage of vanes. The arm 62 is longer than arm 63, which are again longer than arm 64. At the arms the push rods 50 as inventive levers are attached. Therefore a rotating movement of the bell crank 61 is directly applied to the push rods 50 providing a lateral movement of the push rods 50. The other end of the push rods 50 is attached to the driving rings 40, 41, 42, 43 so that the lateral movement of the push rods 50 directly forces the driving rings 40, 41, 42, 43 to execute a rotational movement as indicated by the arrows s1, s2, s3, s4. Due to the different length of arms, the rotational movement may be different such as one ring may turn less than another one.

With the use of a single driving ram the angular position during ram travel is proportional stage to stage.

The rotational movement of the driving rings 40, 41, 42, 43 is applied via connecting piece 21 as a rotational movement as indicated via arrow m2 to the lever 20 of each vane 10, 11, . . . . Thus the original movement of the ram 60 results in a rotation of vanes 10, 11, . . . .

Figure 5:
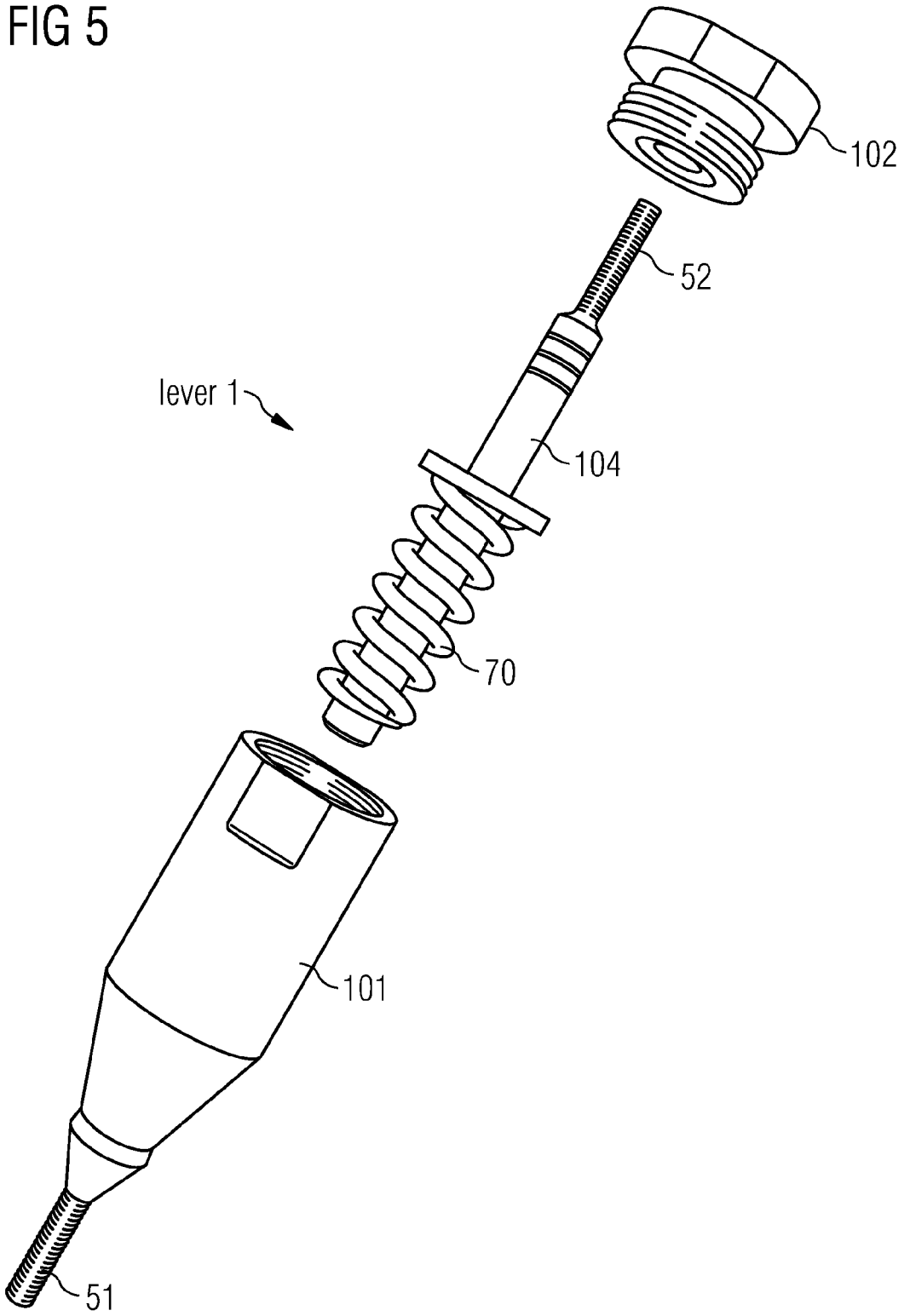
FIG. 5: shows a disassembled sprung push rod according to the invention.
Figure 6:
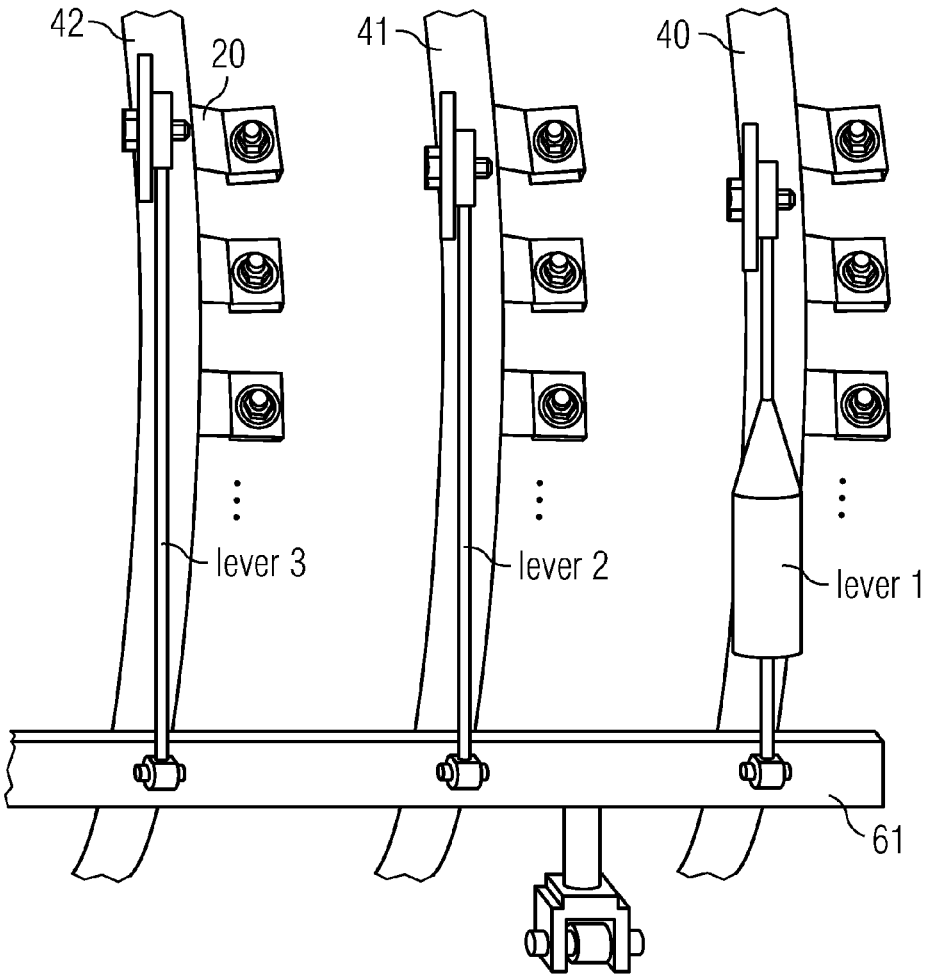
FIG. 6: shows a first position of a sprung push rod applied to a compressor according to the invention.

FIG. 5 shows schematically a disassembled sprung push rod lever 1 according to the invention, which will replace at least one of the push rods 50. The sprung push rod lever 1 comprises a spring 70, a first body part 101 with a first end 51, a cap 102 with a central hole, a spring support 104 with a second connecting end 52.

The first end 51 may be set up to be connected to one of the driving rings 40, 41, 42, 43. The second end 52 may be set up to be connected to the bell crank 61.

The first body part 101 may be screwed together with the cap 102. The spring support 104 and the spring 70 are located inside of the cavity built by the first body 101 and the cap 102. Both may have enough space so that the overall length of the sprung push rod lever 1 from end to end can differ depending upon what force is applied.

Other forms of push rods lever 1 can be envisioned that may show a similar mode of operation.

If only one sprung push rod lever 1 of the first stage of vanes 10 and a fixed length push rod 50 is used for the other stages then it is possible that during operation the driving ring 40 will start to move at a different time than the driving rings 41, 42, 43. Advantageously this is applied during startup of the gas turbine engine.

Besides, during startup of the turbine, the invention allows that:

The first stage vane 10 angular positions remain constant for an initial length—e.g. 10 mm—of ram travel up to an intermediate position while the further stages rotate.

after a ram travel of the initial length—e.g. 10 mm—all the stages of vane rotate in direct proportionality, including the first stage.

Figure 10:
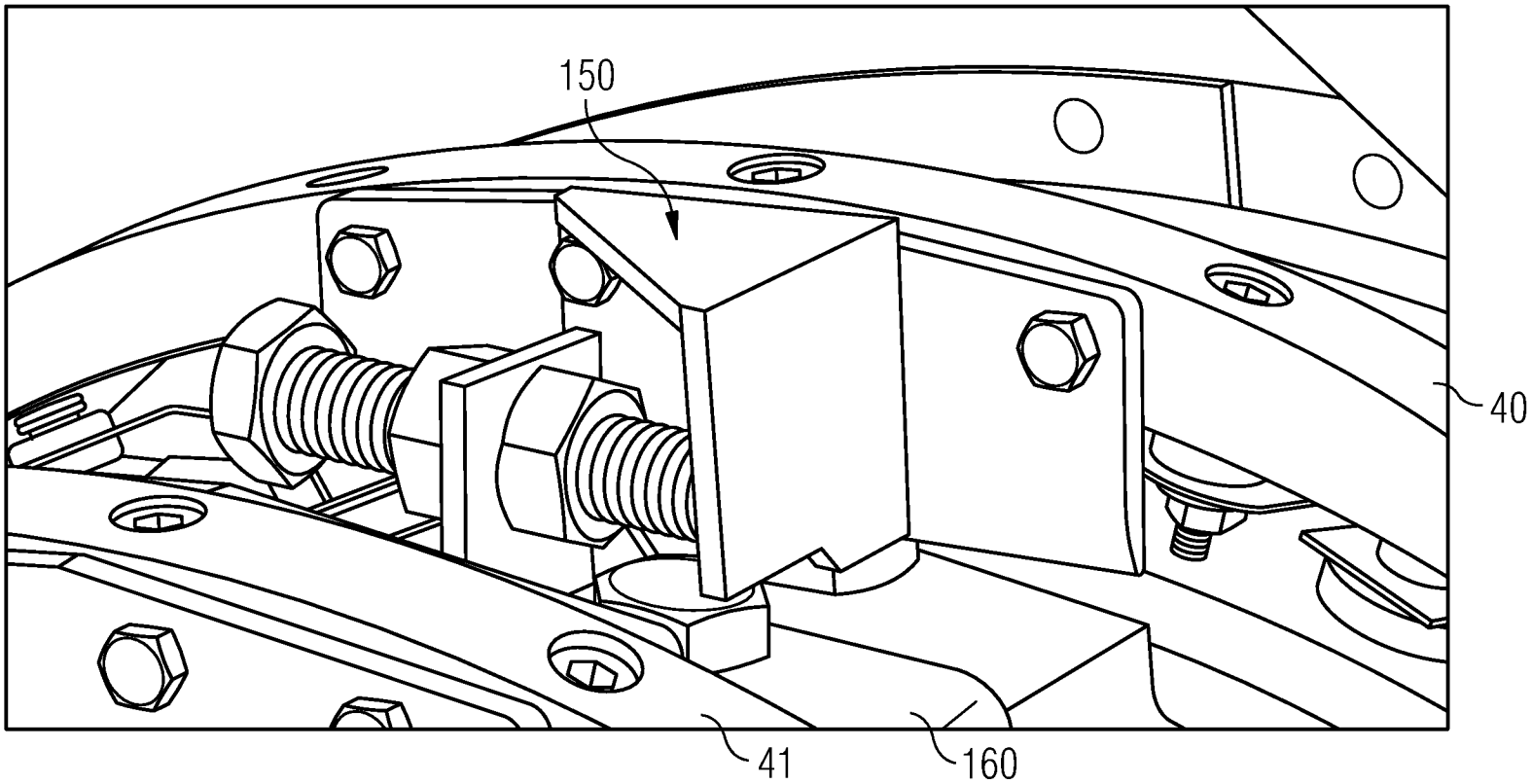
FIG. 10: shows a mechanism to limit the travel of a sprung push rod.

The latter is achieved by a positive stop 150 that is placed on the unison ring at the 10 mm ram travel point. See FIG. 10 for details.

Figure 8:
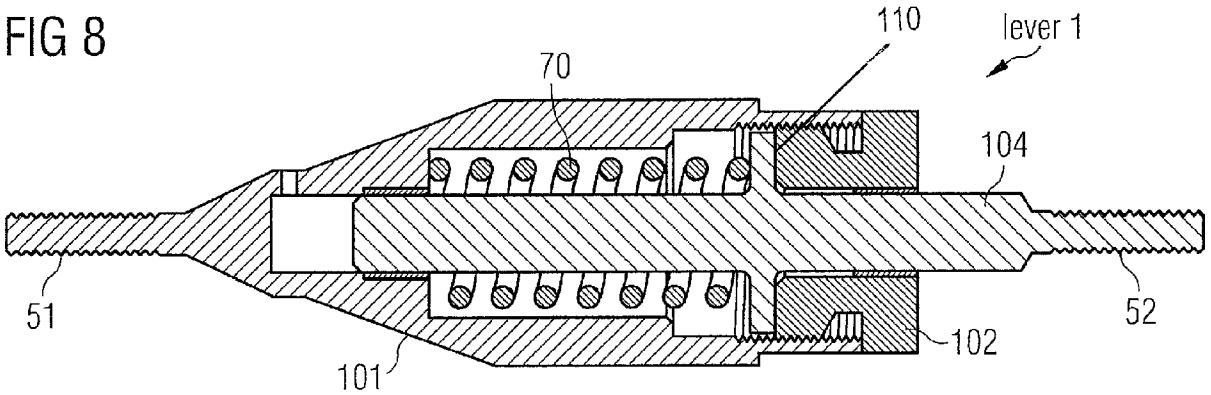
FIG. 8: shows a sectional view of a sprung push rod according to the invention.

During shutdown of the turbine, to allow ram travel back to 0 mm—the original position if turbine is not operating—the push rod lever 1 is designed as a compliant device to stop rod buckling. This device is in the form of a piston—the spring support 104—sliding in a closed cylinder when pulled the piston rests against a stop 110 and transmits all forces. When pushed the piston rest on top of the spring 70. See FIG. 8.

This spring rate is high enough not to deflect during normal travel except when the unison ring 40 hits the stop 150. At the point of hitting the stop 150 the spring compresses allowing continued ram travel and angular changes in all other stages.

Besides the already mentioned items, the invention allows to solve the following problem.

When an axial compressor 1 with several stages is running the compression of the air passing through it is achieved progressively, with similar compression ratios at each stage, so the area of the gas path through the compressor is designed to reduce progressively. At very low speeds, encountered during starting and shutting down of the engine, the early stages—vanes 10 and 11 according to FIG. 2—do not provide sufficient compression to enable the air flow to pass through the rear stages—vanes attached to ring 43—which become "choked". When this occurs the flow can separate on the suction side surface of one or more stages causing that stage to "stall", whereupon the flow reverses in that stage, stalling other stages progressively—almost instantly—until the flow is reversed in the whole compressor 1. As this occurs the high pressure air from the compressor exit flows back through the compressor 1 suddenly causing a 'bang' sound when the pressure wave reaches the compressor inlet. This bang is called "surge" and can be perceived by the uninformed observer as a minor explosion. Normally surges will occur repeatedly until the engine is stopped.

At any given speed there is a maximum pressure ratio that either the whole compressor 1 or an individual stage can achieve without stalling, and the difference between the operating pressure ratio at that speed and the maximum value is referred to as the "surge margin".

To prevent surge on multi stage axial compressors several stages of variable guide vanes are used at the beginning of the compressor to reduce the flow rate at low speed. At low speed these variable guide vanes are closed, and as the speed increases towards running these variable guide vanes are opened to their running position in order to pass more flow. The variable guide vanes are usually moved by a single actuator—the ram 60 and the bell crank 61 according to FIG. 2—with a mechanical linkage enabling successive stages to move different amounts, but according to the prior art all stages move in synchronisation with each other.

For some compressors the optimum movement of each stage across the speed range follows a different pattern from other stages. Still, there may be practical considerations to stay with a single actuator and simple linkage for reliability reasons, so a compromise relationship of variable guide vane movement against speed is used. This is addressed by the invention.

The inventive sprung pushrod lever 1 provides a simple means of changing the relative movement between stages without introducing additional actuators or complex linkages, enabling a better compromise to be selected and providing better start reliability of the engine. It could be applied to any of the variable stages, either at the start end of the actuator movement, or at the run end. The current invention described has applied it to the first variable row called throughout this document as first stage.

With the actuator at the start position the ring that moves the first stage is pushed against a stop 150 on the engine casing by the sprung pushrod lever 1 with the spring 70 being compressed within the pushrod lever 1.

As the actuator—the ram 60 and the bell crank 61 according to FIG. 2—moves from the starting position—defined as 0 mm—to an intermediate position—e.g. 10 mm—the ring 40 is still pushed against the stop so the first stage vanes 10 do not move while the other rows of stators—e.g. vanes 11—are moved directly by the actuator. During this movement the spring 70 within the pushrod lever 1 unloads progressively, allowing the actuator end (the second end 52) of the pushrod lever 1 to move while the ring end (the first end 51) remains stationary and the ring is held against the stop 150 by the spring force.

At the intermediate position of 10 mm the pushrod lever 1 cannot extend any further so movement of the actuator beyond the intermediate position results in the first stage and other stators all moving together according to the geometry of the actuator mechanism. Hence between the intermediate position and the running position the pushrod lever 1 behaves as if it is an unsprung device.

The spring 70 within the pushrod lever 1 has significant pre-load when the pushrod lever 1 is at its fully extended condition, sufficient to move the first stage ring 40 in both directions during running, beyond the intermediate actuator position.

When shutting the engine down the actuator moved progressively from the run position to the start position, according to a pre-defined schedule. Until the actuator reduced to intermediate position of 10 mm, the pre-load in the spring 70 is sufficient to move the first stage ring 40 without any compression of the spring 70. At intermediate position the ring 40 hits the stop 150 and cannot move any further. As the actuator continues to move the spring 70 is compressed, allowing the actuator end (the second end 52) of the pushrod lever 1 to move while the ring end (the first end 51) of the pushrod lever 1 remains stationary.

The invention allows that the further stages move more closed relative to first stage at low speed. Specifically it allows extra movement of the further stages of the variable guide vanes mechanism whilst holding the first stage constant.

The starting angles during start-up of the machine for the first four stages of variable vanes may be some specific angles, for example 35°, 30°, 25°, and 20°. Also it is considered to have specific angles of the blades during operation of the machine, for example: 35°, 21°, 16°, 10°. The movement of the variable guide vanes should follow the latter schedule as closely as possible.

Figure 12:
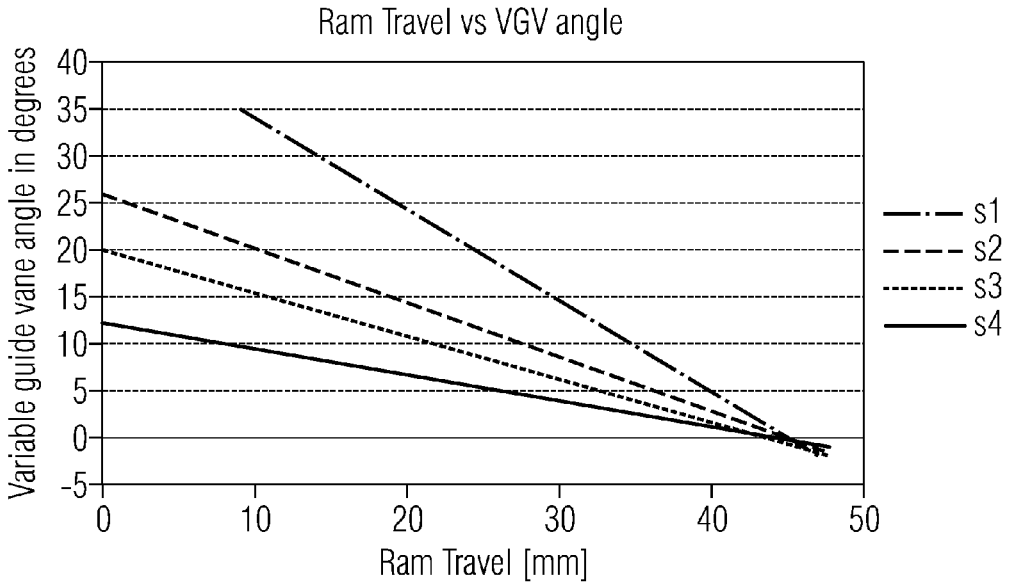
FIG. 12: depicts a graph showing a ram travel of a sprung push rod in comparison to a resulting vane angle.
Figure 13:
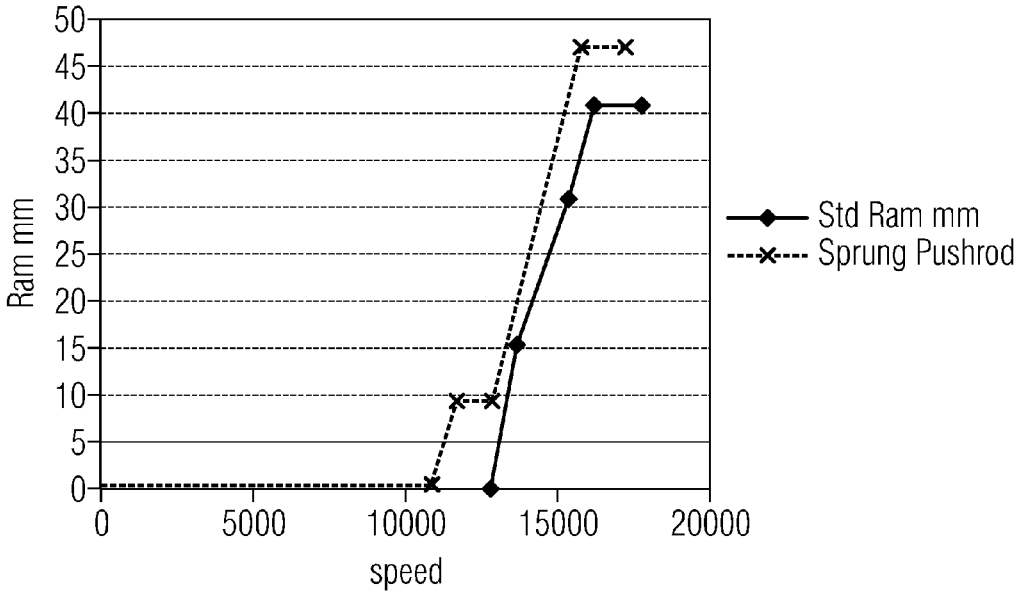
FIG. 13: depicts a graph showing a ram travel of a sprung push rod in comparison to a rotational speed of gas turbine compressor.

The schedule outlined in FIG. 12 should also correspond to the speeds shown in the graph in FIG. 13, which compares the settings of a sprung push rod lever 1 to a setting with a standard and fixed push rod 50.

Figure 7:
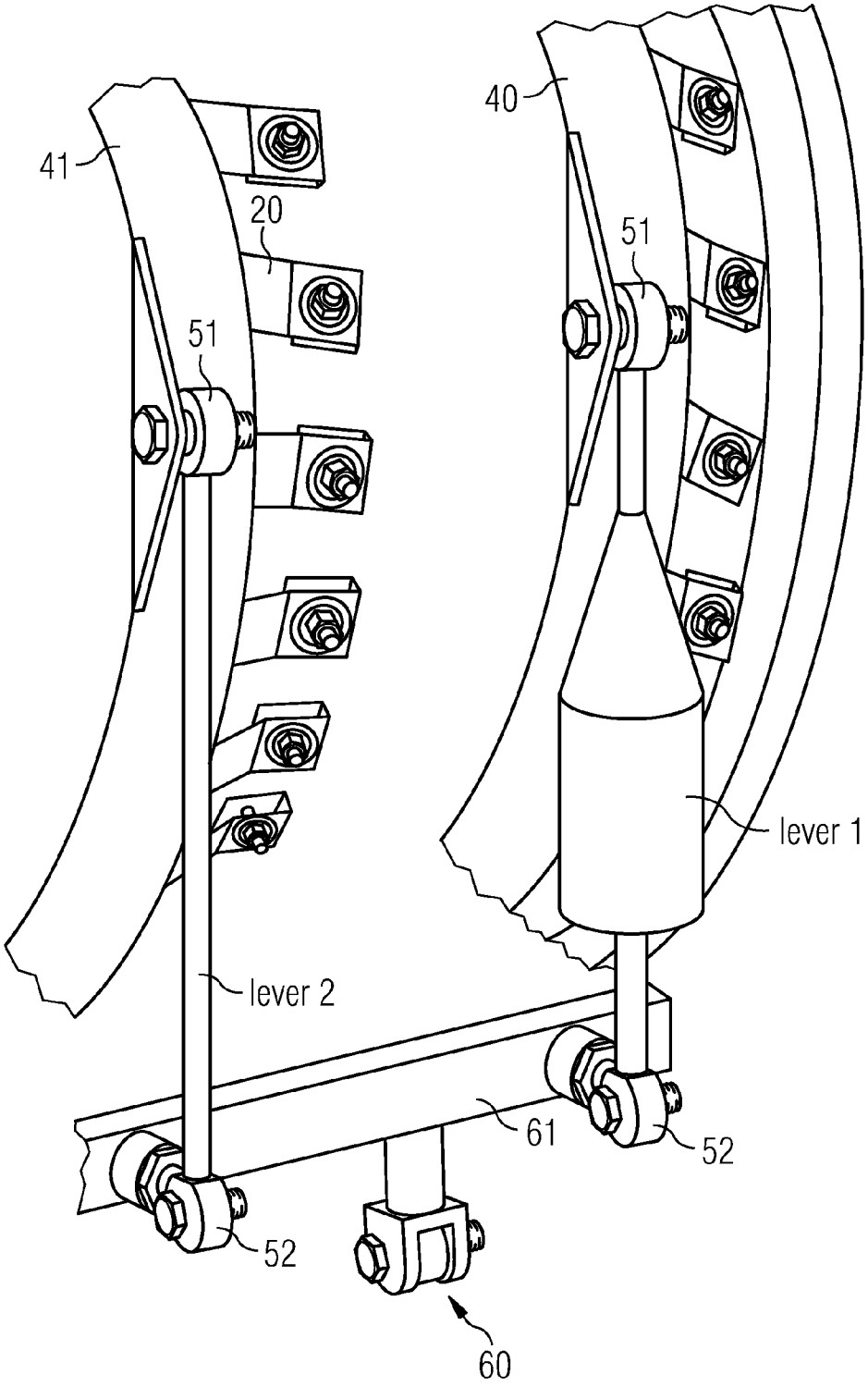
FIG. 7: shows a second position of a sprung push rod applied to a compressor according to the invention.
Figure 11:
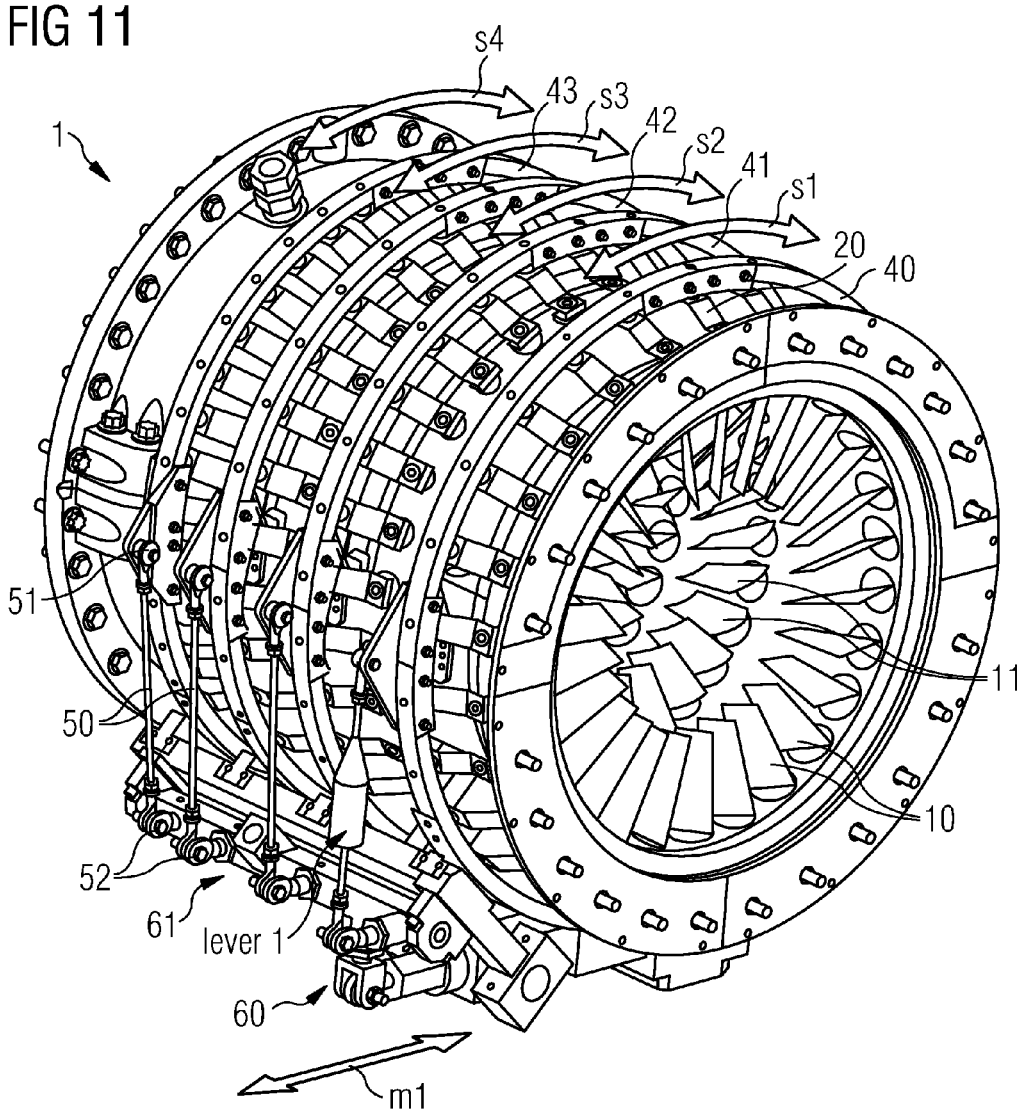
FIG. 11: is a perspective view of a compressor of turbine engine according to the invention.

This type of operation may be provided by a sprung pushrod lever 1 (see FIGS. 5 and 7) coupled with a mechanical stop 150 to hold the first stage at an initial angle, for example of 35°, whilst altering the length of the yoke on the distributor shaft to extract more travel from the further stages. See also FIG. 11.

When holding the first stage at an initial angle a the pushrod lever 1 needs to shorten by 10 mm—taking the exemplary value from above—in order to allow the further stages to continue moving round to their desired positions.

Regarding mechanical stop for first stage:

The sprung pushrod lever 1 needs a mechanical stop 150 to limit the first stage travel, this may be constructed using some simple brackets attached to both the unison ring 40 and the casing 160. See FIG. 10.

Regarding the sprung pushrod lever 1:

The invention allows that force is transferred through the spring 70 without any change in pushrod length meaning the first stage would not be moving at the correct rate.

This is achieved by a spring 70, the spring 70 in the system must have more preload than the force required to move the first stage unison ring 40.

As an example the force required to move a first stage unison ring 40 on a specific gas turbine can be seen in FIG. 14.

Figure 9:
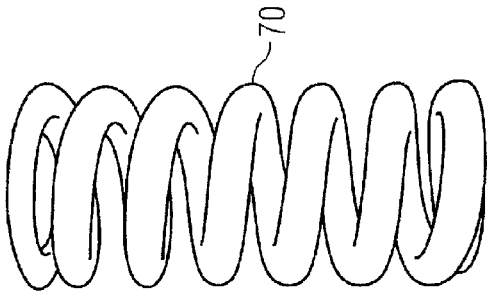
FIG. 9: shows a spring of a sprung push rod.

Preferably the spring 70—see FIG. 9—may be a die spring with a specific spring rate, e. g. of 159 N/mm. As further exemplary values, 2.5 mm of compression may be put onto the spring 70 during assembly giving an initial preload of 397.5 N ensuring that ram force is transmitted without allowing the first stage vanes to lag behind the rest of the mechanism. As already indicated, all values are exemplary.

The design of the sprung pushrod lever 1 is based around the spring size and the required travel length up to the intermediate position, e.g. 10 mm. Two bushes from DU material can be used for the variable guide vanes spindles at each end allowing free running of the shaft inside the body. See FIG. 8.

FIG. 15 is showing the system during startup of the turbine. FIG. 15A shows the generator in idle once it is not in operation. All levers lever 1, lever 2, lever 3 for the stages of the variable guide vanes may ideally be of the same length. This may generally not be necessary.

First ends 51 of levers lever 1, lever 2, lever 3 will be attached to adjusting rings 40, 41, 42—not shown—via which the variable guide vanes 10, 11, . . . get positioned.

During startup the crank 61 slightly rotates. As a result second ends 52 of all of the levers lever 1, lever 2, lever 3 get lowered. For levers lever 2 and lever 3 this has a direct impact to the position of the first ends 51 of these two levers, as can be seen in FIG. 15B. The first end 51 of the first lever lever 1 does not change position during the startup phase, due to extending the length of lever 1 equalised by the spring 70. The difference in position may be the distance d1. Lever lever 1 extends its rod—section marked with the length X will extend to X+d1—until a position is reached that previously was called intermediate position (as depicted in FIG. 15B).

Once the intermediate position is passed during startup, the lever lever 1 will not absorb further rotating movements of the crank 61 but will pass on the longitudinal movement of its second end 52 directly—as it was a rod like lever 2 or lever 3—or slightly absorbed, resulting in a movement of the first end 51 of the lever lever 1. Thus, further rotating the crank 61 will lead the second ends 52 to be the distance of d2 lower than at the intermediate position. The same is true for all three first ends 51 of the levers lever 1, lever 2, lever 3, even for lever 1. The section of the first lever lever 1, previously marked with X and later with X+d1 will stay in its extended position of length X+d1.

As it can be seen, the first stage of vanes will not operated in sync with the other stages of vanes.

The invention claimed is:

1. An adjusting device for guide vanes of an axial-flow machine, comprising:

a plurality of rotatably mounted rings of variable guide vanes each variable guide vane is mounted on a spindle to a guide vane carrier;

a plurality of levers which are arranged on a plurality of outer sides of the guide vane carrier for rotating the variable guide vanes, the plurality of levers move in a circumferential direction in relation to the guide vane carrier;

a plurality of adjusting rings, each of the adjustment rings is arranged coaxially to the guide vane carrier and to which a first end of one of the levers is connected wherein a portion of the plurality of variable guide vanes belong to a stage in which the portion are connected to the same adjusting ring; and an adjusting drive with which the plurality of adjusting rings may be moved in a circumferential direction, wherein at least one of the plurality of levers is set up to perform at least partly a disproportionate longitudinal movement of the first end of the lever, and wherein the disproportionate longitudinal movement of the first end of the lever results in a disproportionate rotation of the respective adjusting ring, wherein a single driving ram is attached to a second end of each of the plurality of levers, wherein the at least one of the plurality of levers comprises a spring, wherein the disproportionate longitudinal movement of the first end of the lever is set up as that from an initial position of the driving ram to an intermediate position where a first stage adjusting ring hits a positive stop wherein the first end of the lever stays immobile in its position, and wherein when the disproportionate longitudinal movement of the first end of the lever is set up as that from the intermediate position of the driving ram a further movement of the driving ram causes the first end of the lever to move as the other first ends of the other levers.

2. The adjusting device according to claim 1, wherein the moving of the first end of the lever results in a first rotation of the respective adjusting ring.

3. The adjusting device according to claim 1, wherein the first rotation of the respective adjusting ring results in a second rotation of the variable guide vanes.

4. The adjusting device according to claim 1, wherein one of the levers further comprises a first body part, the first end, a cap with a central hole, a spring support with a second connecting end.

5. A variable guide vane system of an axial-flow machine, comprising:

a plurality of variable guide vanes, comprising:

an adjusting device, comprising:

a plurality of rotatably mounted rings of the plurality of variable guide vanes such variable guide vane is mounted on a spindle to a guide vane carrier, a plurality of levers which are arranged on a plurality of outer sides of the guide vane carrier for rotating the plurality of variable guide vanes, the plurality of levers move in a circumferential direction in relation to the guide vane carrier, a plurality of adjusting rings, each of the adjustment rings is arranged coaxially to the guide vane carrier and to which a first end of one of the levers is connected wherein a portion of the plurality of variable guide vanes belong to a stage in which the portion are connected to the same adjusting ring, and an adjusting drive with which the plurality of adjusting rings may be moved in a peripheral direction, wherein at least one of the plurality of levers is set up to perform at least partly a disproportionate longitudinal movement of the first end of the lever, and wherein the disproportionate longitudinal movement of the first end of the lever results in a disproportionate rotation of the respective adjusting ring, wherein a single driving ram is attached to a second end of each of the plurality of levers, the at least one of the plurality of levers comprises a spring, wherein the disproportionate longitudinal movement of the first end of the lever is set up as that from an initial position of the driving ram to an intermediate position where a first stage adjusting ring hits a positive stop wherein the first end of the lever stays immobile in its position, and wherein when the disproportionate longitudinal movement of the first end of the lever is set up as that from the intermediate position of the driving ram a further movement of the driving ram causes the first end of the lever to move as the other first ends of the other levers.

6. The variable guide vane system according to claim 5, wherein the moving of the first end of the lever results in a first rotation of the respective adjusting ring.

7. The variable guide vane system according to claim 6, wherein the first rotation of the respective adjusting ring results in a second rotation of the variable guide vanes.

8. The variable guide vane system according to claim 5, wherein one of the levers further comprises a first body part, the first end, a cap with a central hole, a spring support with a second connecting end.

9. A method for adjusting guide vanes of an axial-flow machine for a device, comprising:

performing disproportionate longitudinal movement by a first end of at least one of a plurality of levers, wherein the plurality of guide vanes, comprises:

an adjusting device, comprising:

a plurality of rotatably mounted rings of the plurality of variable guide vanes wherein each guide vane is mounted on a spindle to a guide vane carrier, a plurality of levers which are arranged on a plurality of outer sides of the guide vane carrier for rotating the plurality of variable guide vanes, the plurality of levers move in a circumferential direction in relation to the guide vane carrier, a plurality of adjusting rings, each of the adjustment rings is arranged coaxially to the guide vane carrier and to which a first end of one of the levers is connected wherein a portion of the plurality of variable guide vanes belong to a stage in which the portion are connected to the same adjusting ring, and an adjusting drive with which the plurality of adjusting rings may be moved in a peripheral direction, wherein at least one of the plurality of levers is set up to perform at least partly a disproportionate longitudinal movement of the first end of the lever, wherein the disproportionate longitudinal movement of the first end of the lever results in a disproportionate rotation of the respective adjusting ring, wherein a single driving ram is attached to a second end of each of the plurality of levers, the at least one of the plurality of levers comprises a spring, wherein when the disproportionate longitudinal movement of the first end of the lever is set up as that from an initial position of the driving ram to an intermediate position where a first stage adjusting ring hits a positive stop wherein the first end of the lever stays immobile in its position, and wherein the disproportionate longitudinal movement of the first end of the lever is set up as that from the intermediate position of the driving ram a further movement of the driving ram causes the first end of the lever to move as the other first ends of the other levers.

* * * * *